US005383250A

United States Patent [19]

Sohler

[11] Patent Number: 5,383,250

[45] Date of Patent: Jan. 24, 1995

[54] CLEANING APPARATUS FOR TEXTILE MACHINES

[75] Inventor: Manfred Sohler, Wangen, Germany

[73] Assignee: Sohler Airtex GmbH, Wangen, Germany

[21] Appl. No.: 49,475

[22] Filed: Apr. 19, 1993

[30] Foreign Application Priority Data

Apr. 16, 1993 [DE] Germany ..... 9305741[U]

[51] Int. Cl.[6] ..... B08B 5/00

[52] U.S. Cl. ..... 15/312.2; 15/319

[58] Field of Search ..... 15/312.1, 312.2, 319

[56] References Cited

U.S. PATENT DOCUMENTS 4,121,318 10/1978 Jacobi ..... 15/312.2
4,655,258 4/1987 Breyer et al. .
5,029,360 7/1991 Straub et al. ..... 15/312.1

FOREIGN PATENT DOCUMENTS 7517978 6/1975 Germany .
3503755 8/1986 Germany .

*Primary Examiner*—Chris K. Moore
*Attorney, Agent, or Firm*—Robert W. Becker & Associates

[57] ABSTRACT

A drivable cleaning apparatus for textile machines has air lines that are connected to air hoses. The air hoses are connected to the air lines with swivel joints and are displaceable from a first into a second position by a rotary drive. The rotary drive is designed such that a rotation of the swivel joint past the initial pivoting movement from the first to the second position is possible, thus also allowing for a continuous rotary operation.

18 Claims, 4 Drawing Sheets

CLEANING APPARATUS FOR TEXTILE MACHINES

BACKGROUND OF THE INVENTION

The present invention relates to a drivable cleaning apparatus for textile machines, especially for weaving machines, comprising a blower with air lines connected thereto to which air hoses, especially suction hoses are connected which are rotatable relative to the air lines by a drive device so that the openings of the air hoses are displaced from a first position into a second position, whereby the drive device operates transverse to a track of the cleaning apparatus on which the cleaning apparatus travels.

Such a cleaning apparatus is for example know from German Gebrauchsmuster 75 17 978. This cleaning apparatus allows for the pivoting of an air hose when obstacles are present beside a textile machine. Such an obstacle may, for example, be a operating device which is drivable along the side of the textile machine. According to the aforementioned Gebrauchsmuster the air hose is pivoted out of the travel path of the cleaning apparatus.

A further cleaning apparatus is known from German Patent 35 03 755. These cleaning apparatus designed for circular spinning machines have an S-shaped bent portion whereby this bent portion is provided below a swivel joint. By rotating the swivel joint a change of the distance between the textile machine and the end of the air hose can be obtained. A pivoting of the air hose of at least 90°, in practice of approximately 100°, is possible so that obstacles present within the pivoting zone can be circumvented.

The suggested known solutions are especially designed for circular spinning machines whereby especially the pivoting drive in these suggested devices must continuously be serviced in order to ensure proper functioning of the device. For example, there is a risk that when the suspended hose accidentally hits an obstacle that has not been detected, the respective end abutment of the pivoting drive is displaced. When, for example, blower hoses are used in such a pivoting device, the blowing direction is thus slightly displaced which initially may not be detected, but may result in severe disadvantages with respect to the cleaning effect and thus with respect to the reliability of the cleaning apparatus.

Furthermore, from U.S. Pat. No. 4,655,258 a cleaning apparatus for textile machines is known which operates with a plurality of robot arms that are pivotable and can be guided to a particular location of the textile machine which needs to be cleaned. This solution, however, requires a complicated control and is prone to breakdowns and disturbances.

It is therefore an object of the present invention to provide a cleaning apparatus of the aforementioned kind which is substantially improved with respect to its reliability, whereby, however, a reliable and secure circumvention with respect to obstacles and, optionally, a greater cleaning effect over a greater area can be achieved.

BRIEF DESCRIPTION OF THE DRAWINGS

This object, and other objects and advantages of the present invention, will appear more clearly from the following the specification in conjunction with the accompanying drawings, in which.

SUMMARY OF THE INVENTION

Figure 1:
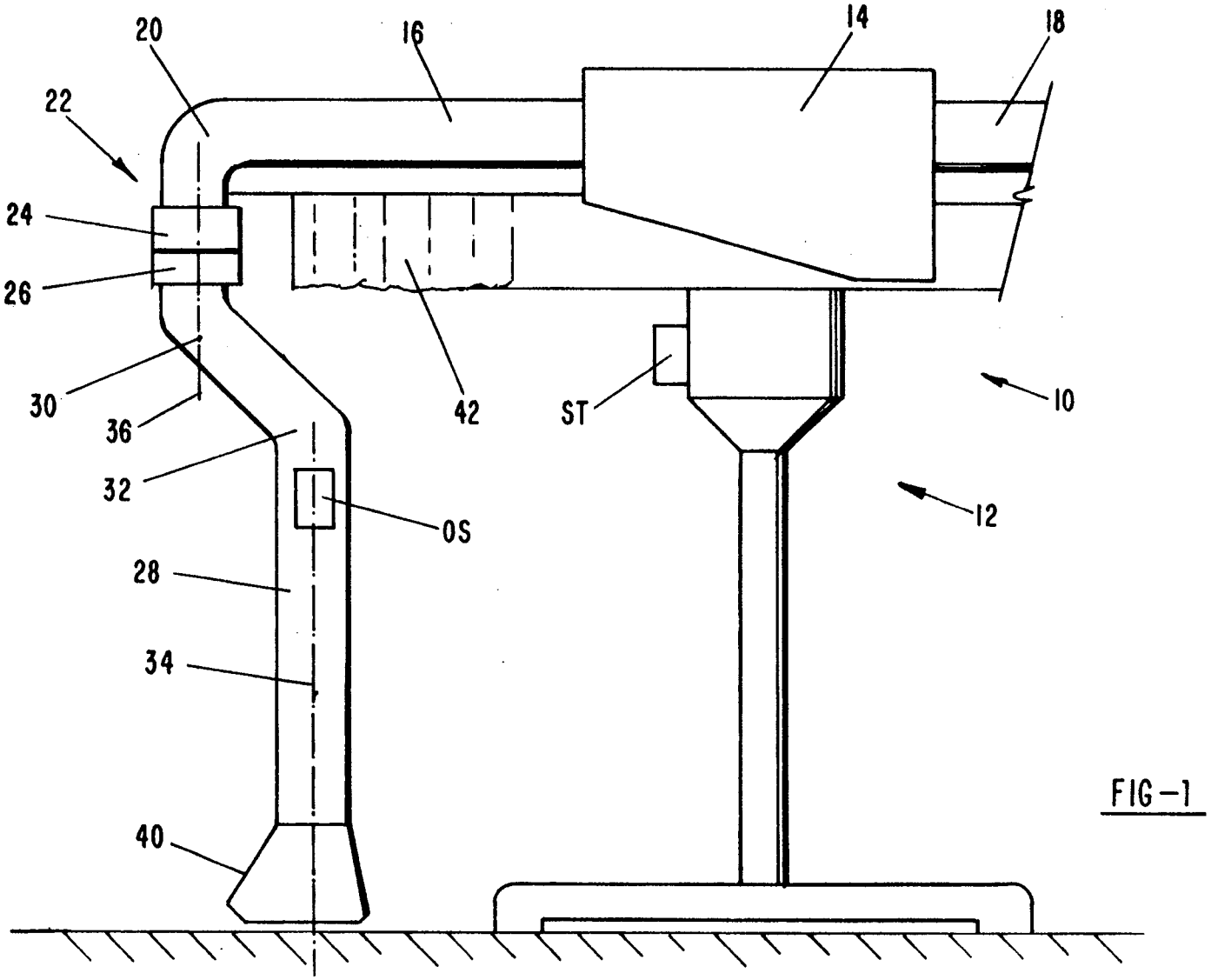
FIG. 1 is a schematic representation of the inventive cleaning apparatus viewed in the direction of travel along the track.

The cleaning apparatus for cleaning textile machines according to the present invention is primarily characterized by:

A track along which the cleaning apparatus is drivable;

A blower;

At least one air line having a first and a second end and connected with a first end to the blower;

At least one air hose with a first and a second end, the first end of said air hose connected to the second end of the air line and the second end of the air hose having an opening; and A rotary drive, operating transverse to the track, for rotating the air hoses relative to the air lines with a swivel joint from a first to a second position and beyond. Preferably, the air hoses are suction hoses.

In a further embodiment of the present invention, the rotary drive rotates the air hoses from the first position into the second position about an angle of 180° and the opening of the air hose is a suction nozzle extending transverse to a direction of travel along the track. The suction nozzle is positioned transverse to the direction of travel in the first and in the second position.

Preferably, the rotary drive during operation of the cleaning apparatus operates continuously and completes a 360° rotation.

Expediently, the air line extends transverse to a direction of travel of the cleaning apparatus and, in the transverse direction, the air line in the first position extends past the air hose and in the second position ends before the air hose.

Preferably, the rotary drive is connected to two adjacent ones of the air hoses, with the air hoses being synchronously rotated.

In a preferred embodiment of the present invention, the cleaning apparatus services a plurality of textile machines. The track then has a plurality of signal transmitters for transmitting control signals in correspondence to the textile machines, the control signals controlling positioning of the swivel joints together with the air hoses into the first and the second positions and optionally further positions.

Preferably, the cleaning apparatus further comprises, for moving the air hose before rotation from the first into the second position, an obstacle sensor connected to the cleaning apparatus, the obstacle sensor detecting obstacles within the path of the cleaning apparatus along the track and actuates the rotary drive for circumventing the obstacle.

Advantageously, the swivel joint is connected between the second end of the air line and the first end of the air hose and has a stationary part and a rotary part. The rotary drive is connected to the rotary part.

Expediently, the axis of the second end of the air hose is displaced relative to an axis of the second end of the air line. Preferably, the first end of the air hose has two bent portions symmetrical to one another for displacing the axis of the second end of the air hose relative to the axis of the second end of the air line.

In another embodiment of the present invention, the rotary drive has a form-locking torque transmitting device with which at least two of the air hoses are symmetrically and synchronously movable relative to one another. Preferably, the torque transmitting device is connected to two of the air hoses such that two of the air hoses are movable in a same direction of rotation. Alternatively, the torque transmitting device is connected to two of the air hoses such that two of the air hoses are movable in opposite directions of rotation. Preferably, the torque transmitting device is a toothed belt. Advantageously, the rotary drive further comprises a drive wheel and a guide roller. The toothed belt is then wound about the drive wheel and the guide roller in an S-shaped path. The drive wheel is preferably elastically biased for maintaining a constant prestress of the toothed wheel. In a preferred embodiment, the swivel joint comprises a stationary part, and roller bearings, whereby the rotary part is inserted into the stationary part and supported with the roller bearings at the stationary part.

In a more preferred embodiment of the present invention, the swivel Joint comprises a stationary part, a rotary part, roller bearings, and a spacer. The stationary part has a first groove and the rotary part has a second groove, the grooves facing one another to form an annular groove. The roller bearings are positioned in the annular groove. The spacer is positioned between the stationary part and the rotary part for adjusting play of the swivel joint.

In an advantageous embodiment of the present invention the air hose is rigid and the opening of the air hose has a flat nozzle, the air nozzle in the first position being positioned at a slant relative to a direction of travel of the cleaning apparatus on the track.

In an alternative embodiment of the present invention, the cleaning apparatus comprises a track along which the cleaning apparatus is drivable, a blower, at least one air line having a first and a second end and connected with the first end to the blower, at least one air hose with a first and a second end, the first end connected to the air line and the second end having an opening, the opening being displaceable from a first to a second position and vice versa in a direction transverse to a direction of travel of the cleaning device on the track; and a telescopic drive, operating transverse to the track for adjusting a length of the airlines transverse to the direction of travel.

The invention has the advantage that the drive is in the form of a rotary drive and thus operates with a certain tolerance to impact. When an obstacle occurs that has not been detected by the obstacle sensor and therefore impacts on the air hose in the first or in the second position, the air hose is simply further rotated independent of the direction in which the cleaning apparatus travels at the time.

It is especially advantageous that with the inventive rotary device the displacement in the lateral direction is essentially doubled with respect to the known solutions which allows for a correspondingly reduced constructive width within the stationary zone of the air lines.

With a reduced constructive width it is possible to use, under certain circumstances, the cleaning apparatus even with sharp turns in the track which results in considerable cost reduction.

According to a preferred embodiment it is suggested that the rotary drive acts on two adjacently arranged air hoses such that they are rotated synchronously relative to one another. The synchronous movement, for example, can be achieved by a toothed belt which is wound about two swivel joints and which is driven by a respective electric motor. Accordingly, a separate drive for each swivel joint is no longer necessary which considerably reduces the total cost for the manufacture of the cleaning apparatus.

It is understood that the drive unit of the inventive rotary drive for providing the circumventing movement can be embodied in any suitable manner. For example, instead of an electromechanical solution it is possible to provide an electrohydraulic or a pneumatic solution. The activation of the rotary drive from a first into a second position, but for example also vice versa, can be achieved with a corresponding signal unit (signal transmitter or obstacle sensor) which can respond to obstacles or can be controlled by the track. It is also possible to employ a combination of track control and obstacle sensing. It is understood that suction as well as blowing hoses can be used as air hoses with the inventive rotary drive. It is furthermore possible to provide the air hoses as rigid hoses or flexible hoses.

With a further advantageous embodiment according to which a rigid embodiment of the suction hoses with the rotary drive is suggested, the rotary drive is operated continuously. This embodiment is advantageous because a considerably wider area at the sides of the textile machines can be suction-cleaned than has been possible with prior art devices. It is understood that in this solution the drive velocity of the cleaning apparatus and the drive velocity of the rotary drive must be adjusted to one another.

According to a further embodiment which is especially advantageous for the last mentioned solution, the suction nozzle is not exactly aligned at a right angle to the direction of travel of the cleaning apparatus, but is positioned at a slant, for example, at an angle of 45° to 55°. In this solution it is ensured that the suction nozzle does not have its narrowest effective width exactly at the 90° position, i.e., the center position between the first and the second position, with respect to the direction of travel of the cleaning apparatus, but, for example, at the 45° position, respectively, at the 25° position. The respective location adjacent to the track, however, is then covered by and cleaned with the cleaning apparatus in the position 315°, respectively, 135° with the widest possible effective width.

According to a further advantageous embodiment it is suggested to realize the control of the rotary drive with a selector switch having three positions. In the first position of the selector switch a rotation of the air hose from the first into the second position takes place under control of the obstacle sensor or the signal transmitters at the track, and vice versa, In the second position of the selector switch a rotation from the first into the second position takes place as a function of the obstacle sensor and/or the signal transmitters at the track, and vice versa. In the third position a continuous cleaning operation with continuous rotation of the air hoses is performed, whereby, however, an obstacle control prevents a collision between air hoses and an obstacle.

According to an alternative embodiment of the inventive cleaning apparatus it is suggested to replace the rotary drive by a telescopic drive.

In this solution the construction above the air hoses, i.e. the area of the air lines, can be embodied in an even narrower construction. For this purpose, the air lines themselves are telescopic so that this solution is also possible for tracks with sharp turns which, in known prior art devices, could not be maneuvered so that two separate cleaning devices had to be used.

DESCRIPTION OF PREFERRED EMBODIMENTS

The present invention will now be described in detail with the aid of several specific embodiments utilizing FIGS. 1 through 3.

The inventive cleaning apparatus 10 represented in FIG. 1 is drivable along a track 12 above weaving machines, not represented in the drawing, which are arranged in series. The cleaning apparatus comprises a blower housing 14 in which a non-represented blower is positioned. Connected to the blower housing 14 are laterally extending air lines whereby in the representation according to FIG. 1 blower lines are covered by the suction lines. The air line 16 ends, as does the non-represented air line 18, after a 90° bend 20, below which the air line 16 extends substantially vertically downwardly, and is connected to a swivel joint 22 that is comprised of a stationary part 24 and a rotary part 26. The rotary part 26 is rotatable within the stationary part 24 whereby the particular embodiment can be seen in detail in FIG. 3. The rotary part 26 is connected to an air hose 28 which at 30 and 32 is bent so that the axis 34 of the air hose 28 is parallel to the axis 36 of the swivel joint 22, but is displaced relative to the axis 36.

Figure 1A:
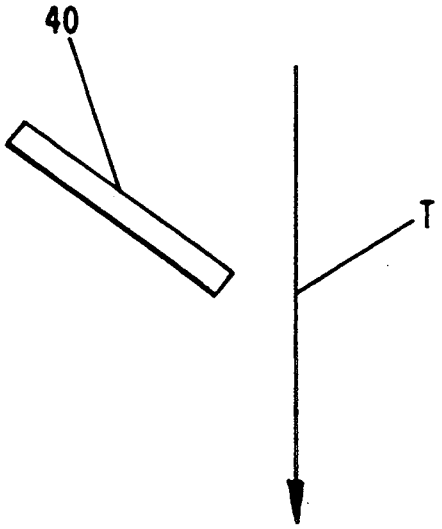
FIG. 1*a* shows a schematic top view of the nozzle in a slanted position relative to the direction of travel.

The air hose 28 in the shown embodiment is a suction hose and ends in a suction nozzle 40 which is wide and extends transverse to the track. When the cleaning apparatus services a plurality of textile machines, the track has a plurality of signal transmitters ST (see FIG. 1) for transmitting control signals in correspondence to the textile machines. The control signals control positioning of the swivel joint together with the air hoses into the first and the second positions and optionally further positions. Preferably, the cleaning apparatus further comprises, for moving the air hoses before rotation from the first into the second position, an obstacle sensor OS (see FIG. 1) connected to the cleaning apparatus. The obstacle sensor OS detects obstacles within the path of the cleaning apparatus along the track and actuates the rotary drive for circumventing the obstacle. The air nozzle 40 in the first position may be positioned at a slant relative to the direction of travel T of the cleaning apparatus on the track (FIG. 1*a*).

FIG. 1 furthermore shows blower hoses 42 in a dash-dotted line extending from a blower line.

The rotary position of the swivel joint 22 in the representation according to FIG. 1 is the inwardly oriented position which in the following is designated the first position. When rotating the rotary part 26 about 180° the outwardly oriented or second position is reached in which the bent portion 20 extends laterally outwardly past the air line 16. For a total width of the cleaning apparatus of, for example, two meters the suction nozzle 40 covers for example 400 mm in the lateral direction.

Figure 2:
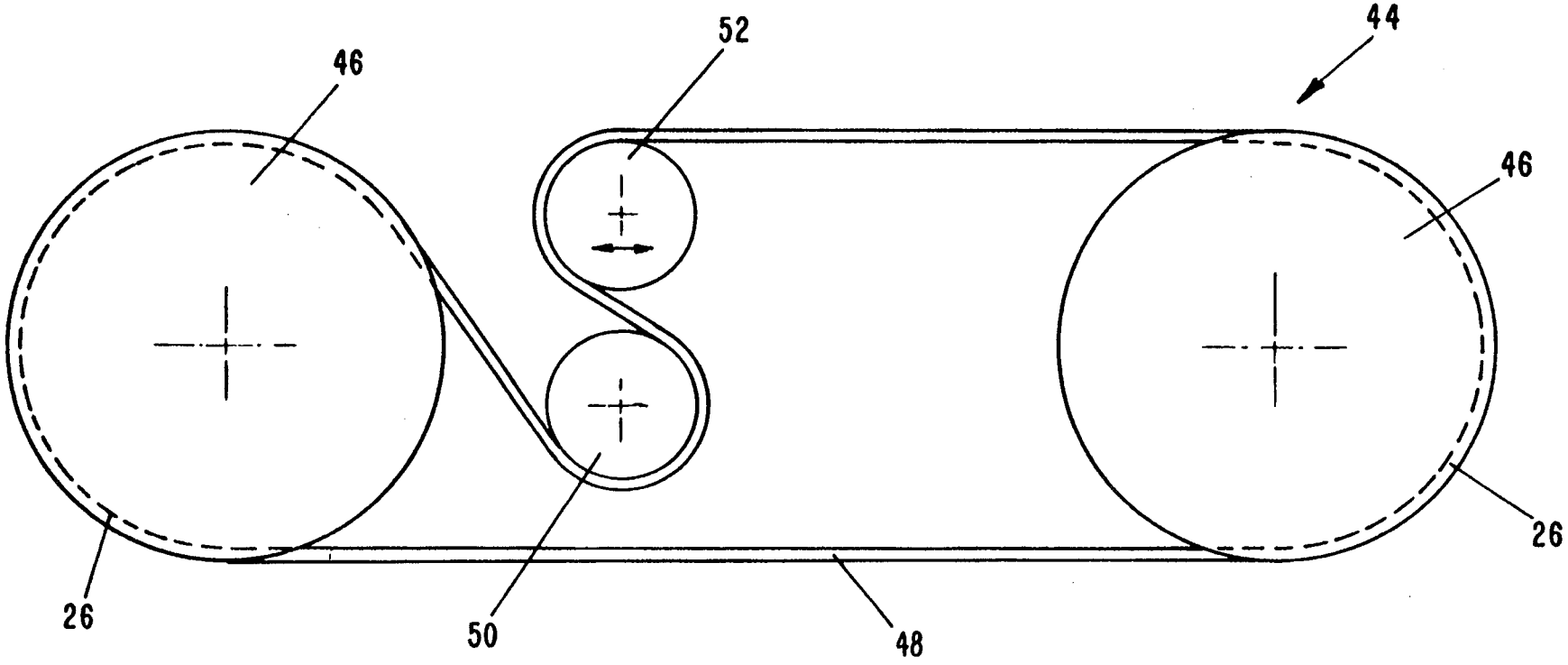
FIG. 2 is a schematic plan view of an inventive embodiment of a rotary drive when using two rotatably driven air hoses.

The embodiment of an inventive rotary drive 44 is represented in FIG. 2. The rotary drive 44 acts on the rotary part 26 of the swivel joint 22 while the stationary part 24 of the swivel joint is not represented in this drawing. The rotary part 26 comprises a toothed wheel 46, represented in FIG. 3 in a cross-sectional view, which guides a toothed belt 48 wound about two rotary parts 26 of adjacent air hoses 28. The toothed belt 48 in the embodiment according to FIG. 2 has teeth on both sides. The toothed belt 48 is wound in an S-shaped manner about the combination of drive wheel 50 with guide roller 52. The guide roller 52 is elastically biased in the direction of prestress of the toothed belt 48 so that the guide roller 52 maintains the toothed belt 48 at a constant prestress. The drive wheel 50 is connected to an electric motor which is designed such that upon rotation of about 720°, both air hoses 28 are transferred from the first to the second position and are thus rotated by 180°. It is understood that in the embodiment represented in FIG. 2 the toothed belt synchronously drives the air hoses 28 in the same direction of rotation. When it is desired to provide for a synchronous rotation in opposite directions, this can be simply realized by guiding the toothed belt 48 within the area of the toothed disk 46 in a crossed (figure eight) manner. In order to prevent the two sides of the toothed belt from coming into contact with one another in this embodiment it is suggested to arrange the unit comprised of guide roller 52 and drive wheel 50 in a somewhat tilted arrangement. With a respective elastic travel of the guide roller 52 in the same embodiment the change in length of the toothed belt resulting from the crossed or straight arrangement in order to provide for a unidirectional or counter directional rotation of the two air hoses can be compensated.

When the positions of the guide roller 52 and the drive wheel 50 are switched it is also possible to operate the drive with a toothed belt 48 that is provided with teeth only on one side. It is understood that the elastic force which acts on the guide roller 52 must be selected such that when starting the electric motor for the drive wheel the guide roller 52 does not give way elastically.

Figure 3:
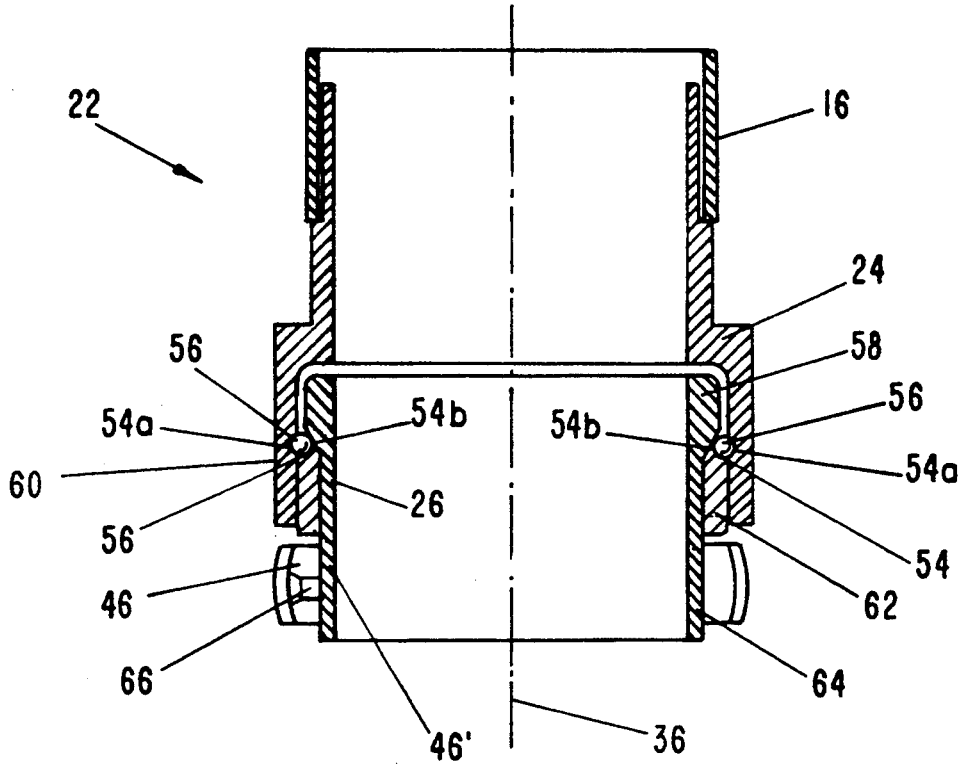
FIG. 3 is a cross-section of a swivel joint for use with the inventive rotary drive.

The representation according to FIG. 3 shows a swivel joint 22 whereby identical reference numerals are used for identical parts. The stationary part 24 of the swivel joint 22 projects relative to the air line 16 and is provided with an inner circumferential Groove 54*a* which is designed to receive roller bodies 56, for example, balls. On the other hand, the rotary part 26 is provided with a projection 58 that projects outwardly and fits into the stationary part 24. Below this projection an outer circumferential Groove 54*b* is formed corresponding to the Groove 54*a* of the stationary part 24. The projection 58 at its lower end is provided with a slanted downwardly oriented shoulder 60 which serves as a support relative to the roller bodies 56, and together with a spacer 62 which is slipped over the rotary part 26 into the vicinity of the shoulder 60 the projection 58 defines the groove 54*b*. The inner diameter of the swivel joint 22 remains constant over the entire axial length and thus corresponds to the inner diameter of the air hose 28.

Due to the large diameter of the annular groove 54, comprised of the grooves 54*a*, 54*b*, a plurality of roller bodies 56 can be received within the annular groove 54 so that the load is distributed such that for the embodiment of the parts of the swivel joint 22 common steel can be used.

The spacer 62 is axially guided on a neck 64 of the rotary part 26 below the projection 58. Via the axial displacement of the spacer 62 the play of the swivel joint can be adjusted as desired. In the slot between the stationary and the rotary parts 24, 26 below and above the roller bodies 56 sealing lips are provided. The space between the sealing lips is completely filled with a lubricant so that the swivel joint is maintenance-free and can be operated over an extended period of time.

It is obvious that the inventive swivel joint allows for a rotation in excess of the pivoting movement so that also a continuous operation is possible.

For the adjustment of the play the toothed wheel 46 is axially displaceable on the neck 64.

This can be achieved either by an inner thread or, for example, by an eccentric, allowing for a height adjustment of the toothed wheel 46 on which the spacer 62 rests. The toothed wheel 46 is preferably provided with a convex outer shape so that despite the self-centering function the toothed belt 48 can be easily removed, if necessary.

When realizing the adjustment with a screw connection, it is suggest to provide a safety means in the form of a screw 66 which secures the rotational position of the toothed wheel 46 on the neck 64.

It is understood that instead of the exemplary representations of embodiments in the drawings the rotary drive with a toothed belt can also be realized with other suitable means for a rotary drive, such as a chain or an individual drive for the two swivel joints. If desired, it is also possible to actuate the two swivel joints independent from one another, even though a synchronous actuation is preferred.

The present invention is, of course, in no way restricted to the specific disclosure of the specification and drawings, but also encompasses any modifications within the scope of the appended claims.

What I claim is:

1. A cleaning apparatus for cleaning textile machines, comprising:

a track along which said cleaning apparatus is driveable;

a blower;

at least one air line having a first end and a second end with said first end connected to said blower;

at least one air hose with a first end and a second end, said first end of said at least one air hose connected to said second end of said at least one air line and said second end of said at least one air hose having an opening;

a swivel joint connected between said second end of said at least one air hose and said first end of said at least one air line; and a rotary drive acting on said swivel joint for rotating said at least one air hose relative to said at least one air line from a first position into a second position and optionally beyond said second position into a third position.

2. A cleaning apparatus according to claim 1, wherein said air hoses are suction hoses.

3. A cleaning apparatus for cleaning textile machines, comprising:

a track along which said cleaning apparatus is driveable;

a blower;

at least one air line having a first end and a second end with said first end connected to said blower;

at least one air hose with a first end and a second end, said first end of said at least one air hose connected to said second end of said at least one air line and said second end of said at least one air hose having an opening;

a rotary drive for rotating said at least one air hose relative to said at least one air line with a swivel joint from a first position into a second position and optionally beyond said second position into a third position;

wherein said rotary drive rotates said air hoses from said first position into said second position about an angle of 180° and wherein said opening of said air hose is a suction nozzle extending transverse to a direction of travel along said track, with said section nozzle positioned transverse to said direction of travel in said first and in said second position.

4. A cleaning apparatus for cleaning textile machines, comprising:

a track along which said cleaning apparatus is driveable;

a blower;

at least one air line having a first end and a second end with said first end connected to said blower;

at least one air hose with a first end and a second end, said first end of said at least one air hose connected to said second end of said at least one air line and said second end of said at least one air hose having an opening;

a rotary drive for rotating said at least one air hose relative to said at least one air line with a swivel joint from a first position into a second position and optionally beyond said second position into a third position;

wherein during operation of said cleaning apparatus said rotary drive operates continuously so as to complete a 360° rotation.

5. A cleaning apparatus according to claim 1, wherein:

said air line extends transverse to a direction of travel of said cleaning apparatus; and in said transverse direction said air line in said first position extends past said air hose and in said second position ends before said air hose.

6. A cleaning apparatus for cleaning textile machines, comprising:

a track along which said cleaning apparatus is driveable;

a blower;

at least one air line having a first end and a second end with said first end connected to said blower;

at least one air hose with a first end and a second end, said first end of said at least one air hose connected to said second end of said at least one air line and said second end of said at least one air hose having an opening;

a rotary drive for rotating said at least one air hose relative to said at least one air line with a swivel joint from a first position into a second position and optionally beyond said second position into a third position;

wherein said rotary drive drives two adjacent ones of said air hoses, with said air hoses being synchronously rotated.

7. A cleaning apparatus according to claim 1, wherein:

said cleaning apparatus services a plurality of textile machines; and said track has a plurality of signal transmitters for transmitting control signals in correspondence to the textile machines, said control signals controlling positioning of said air hoses into said first and said second positions and optionally further positions.

8. A cleaning apparatus according to claim 7, further comprising, for moving said air hoses before rotation from said first into said second position, an obstacle sensor connected to said cleaning apparatus, which obstacle sensor detects obstacles within the path of said cleaning apparatus along said track and actuates said rotary drive for circumventing the obstacle.

9. A cleaning apparatus according to claim 1, wherein said swivel joint has a stationary part and a rotary part and wherein said rotary drive is connected to said rotary part.

10. A cleaning apparatus according to claim 1, wherein an axis of said second end of said air hose is displaced relative to an axis of said second end of said air line.

11. A cleaning apparatus according to claim 10, wherein said first end of said air hose has two bent portions point-symmetrical to one another for displacing said axis of said second end of said air hose relative to said axis of said second end of said air line.

12. A cleaning apparatus for cleaning textile machines, comprising:

a track along which said cleaning apparatus is driveable;

a blower;

at least one air line having a first end and a second end with said first end connected to said blower;

at least one air hose with a first end and a second end, said first end of said at least one air hose connected to said second end of said at least one air line and said second end of said at least one air hose having an opening;

a rotary drive for rotating said at least one air hose relative to said at least one air line with a swivel joint from a first position into a second position and optionally beyond said second position into a third position;

wherein said rotary drive has a form-locking torque transmitting device in the form of a toothed belt with which toothed belt at least two of said air hoses are symmetrically and synchronously movable relative to one another.

13. A cleaning apparatus according to claim 12, wherein said toothed belt is connected to two of said air hoses such that said air hoses are movable in a same direction of rotation.

14. A cleaning apparatus according to claim 12, wherein said toothed belt is connected to two of said air hoses such that said air hoses are movable in opposite directions of rotation.

15. A cleaning apparatus according to claim 12, wherein:

said rotary drive further comprises a drive wheel and a guide roller;

said toothed belt is wound about said drive wheel and said guide roller in an S-shaped path; and said guide roller is elastically biased for maintaining a constant prestress of said toothed wheel.

16. A cleaning apparatus according to claim 1, wherein said swivel joint comprises a stationary part, a rotary part, and roller bearings, with said rotary part inserted into said stationary part and supported with said roller bearings at said stationary part.

17. A cleaning apparatus according to claim 1, wherein:

said swivel joint comprises a stationary part, a rotary part, roller bearings, and a spacer;

said stationary part has a first groove and said rotary part has a second groove, said first and said second grooves facing one another to form an annular groove, with said roller bearings positioned in said annular groove; and said spacer positioned between said stationary part and said rotary part for adjusting play of said swivel joint.

18. A cleaning apparatus for cleaning textile machines, comprising:

a track along which said cleaning apparatus is driveable;

a blower;

at least one air line having a first end and a second end with said first end connected to said blower;

at least one air hose with a first end and a second end, said first end of said at least one air hose connected to said second end of said at least one air line and said second end of said at least one air hose having an opening;

a rotary drive for rotating said at least one air hose relative to said at least one air line with a swivel joint from a first position into a second position and optionally beyond said second position into a third position;

wherein said air hose is rigid and said opening of said air hose has a flat nozzle, said flat nozzle in said first position being positioned at a slant relative to a direction of travel of said cleaning apparatus on said track.

* * * * *